United States Patent [19]

Thomanek

[11] 4,112,847

[45] Sep. 12, 1978

[54] WARHEAD WITH A DISINTEGRATING JACKET TO HOUSE SEVERAL PROJECTILES

[75] Inventor: Franz Rudolf Thomanek, Sandizell, Germany

[73] Assignee: Messerschmitt-Bolkow-Blohm Gesellschaft mit Beschrankter Haftung, Munich, Germany

[21] Appl. No.: 97,451

[22] Filed: Dec. 8, 1970

[30] Foreign Application Priority Data

Dec. 10, 1969 [DE] Fed. Rep. of Germany ..... 1961881

[51] Int. Cl.[2] ..... F42B 13/50; F42C 11/00

[52] U.S. Cl. ..... 102/67; 102/69; 102/205

[58] Field of Search ..... 102/7.2, 67, 69, 70.2 R, 102/76

[56] References Cited

U.S. PATENT DOCUMENTS

| | | | |
|---|---|---|---|
| 1,235,637 | 8/1917 | Barlow | 102/7.2 |
| 3,175,489 | 3/1965 | Reed, Jr. | 102/70.2 R |
| 3,185,097 | 5/1965 | Cushing et al. | 102/7.2 X |

*Primary Examiner*—Verlin R. Pendegrass

[57] ABSTRACT

A warhead with a disintegrating jacket to house several projectiles, in particular splinter projectiles. The projectiles are each equipped with an ignition and backfiring system and fall to earth individually after disintegration of the warhead jacket. They are then fired upwards by means of the backfiring charge ignited by the ignition system, the charge explosive then being detonated. The ignition system of each projectile consists of a time-delay fuze and an impact fuze. The time-delay fuze is initiated when the projectile impacts with relatively soft ground and ignites the backfiring charge after adjusted times differing at least partly for the individual projectiles. The impact fuze, however, effects an immediate ignition of the backfiring charge when the projectile strikes relatively hard ground.

11 Claims, 7 Drawing Figures

INVENTOR
Franz Rudolf Thomanek
by
ATTORNEYS

INVENTOR
Franz Rudolf Thomanek
by
ATTORNEYS

INVENTOR
Franz Rudolf Thomanek
by
ATTORNEYS

INVENTOR
Franz Rudolf Thomanek
by
ATTORNEYS

WARHEAD WITH A DISINTEGRATING JACKET TO HOUSE SEVERAL PROJECTILES

SUMMARY OF THE INVENTION

The invention relates to a warhead with a disintegrating jacket to house several projectiles, in particular splinter projectiles, each of them being equipped with an ignition and backfiring system, falling to earth individually after disintegration of the warhead jacket, and being then fired upward by means of the backfiring charge ignited by the ignition system, the charge explosive then being detonated.

In the case of military conflicts, it is often necessary or advisable for tactical reasons to combat relatively large ground areas for a prolonged period. Warheads of the abovementioned type are mainly used nowadays for this combat, since their effectiveness is by far superior to that of warheads equipped with shells detonating directly on the ground, which is due to the facts that the bursting point is re-lifted from the ground to the adjacent air region and that an increased splinter effect results therefrom.

According to the U.S. Pat No. 3,175,489, a shell is known which rises into the adjacent air region from impact before exploding, an electrical ignition system being coordinated with the backfiring charge that is pyrotechnically coupled with the splinter-producing explosive charge. This electrical ignition system is activated immediately after impact of the shell with the ground. When a vehicle or a person with a rifle or the like approaches, the backfiring charge is ignited. The ignition system comprises among others two electrodes which, after impact of the shell with the ground, create an electrical cell with an electrolyte solution, a frangible container with contains the electrolyte solution and shatters when the shell strikes the ground, and a switch with two crossing magnetic needles the ends of which are embedded in a block of plastics soluble in acetone. The dissolution of the plastic block by the acetone solution starts when the shell impacts with the ground, while said acetone solution is kept away from the plastic hook by a frangible diaphragm before the impact. The magnetic needles moving freely after the dissolution of the plastic block orient themselves according to the magnetic field existing within the range of the shell and close the hitherto interrupted, but already activated ignition circuit as soon as the magnetic field local to the shell is disturbed.

It is apparent from the above description that the known splinter-producing shell, in particular its ignition system, is of a complicated constructions. Its high sensitivity to temperature and susceptibility to shock are due to this construction. These characteristics are extremely disadvantageous, since it is not seldom that such shells are exposed to extreme temperatures during storage and operation, and even when they are handled with the utmost care, they may sometimes be subject to jolting during transport to their destination. A considerable dange is above all the possibility of premature failures of the container containing the electrolyte solution and of the diaphragm keeping the acetone solution away from the acetonesoluble plastic block which fixes the magnetic needles. Such failures lead to a premature activation of the ignition system and to a premature release of the magnetic-needle switch.

The known shell has another disadvantage: As has already been mentioned, its effectiveness is by far superior to that of a shell detonating directly on the ground, which is due to the re-lifting of its bursting point from the ground to the adjacent air region, but this is valid only when the shell has reached a very definite distance from the ground at the moment of the detonation of its explosive charge. Because of the quantitative limitation of the backfiring charge implied by the construction this optimum distance is reached only, if the central longitudinal axis of the shell is in a vertical or nearly vertical position when the backfiring charge is ignited. This is the case only when the shell strikes relatively soft ground, because with such a nature of the ground the projectile falling to earth vertically penetrates deeply enough and gets stuck maintaining its original position. If, however, the known shell impacts with relatively hard ground the abovementioned condition for achieving the optimum distance between the ground and the detonating shell is not fulfilled, because the shell falling vertically to earth upsets immediately after striking hard ground.

It shall finally be mentioned that due to the design of their sensitive ignition systems as proximity ignition systems the shells of the type described above are not suited to combat ground areas at predetermined time intervals for prolonged periods which is often necessary or desirable from the military point of view.

The invention is therefore based on the task of developing a warhead of the kind mentioned at the beginning which is simple in construction and outstandingly suited to combat ground areas for prolonged periods at predetermined time intervals and to avoid in a simple way the disadvantages of the known type of shells for its projectiles.

According to the invention this task is solved in that the ignition system consists of a time-delay fuze, which is initiated when the projectile impacts with relatively soft ground and which ignites the backfiring charge after adjusted times differing at least partly for the individual projectiles, and moreover of an impact fuze, which immediately ignites the backfiring charge when the projectile strikes relatively hard ground.

Owing to the special design of the ignition systems of its projectiles the warhead according to the invention ensures that — independently of whether the ground within the impact region is hard or soft — the projectiles, which fall to earth individually after the disintegration of the warhead jacket that is predetermined with respect to time and which strike the ground vertically, are always re-lifted into the adjacent air region after the ignition of their backfiring charges up to a height enabling them to achieve optimum penetration effects and maximum splinter densities after the detonation of their explosive charges following the backfiring, said explosive charges being provided preferably with preformed splinters. The facts that the ignition of the bakcfiring charges is delayed when the respective projectiles impact with relatively soft ground and that these delays can be adjusted for at least part of the projectiles make it moreover possible to combat ground areas of corresponding nature for prolonged periods at predetermined time intervals. The ground area that can still be controlled unobjectably by means of a single specimen of the warhead according to the invention and the time of prolonged combating this area depend on:

a. the total number of projectiles housed in the disintegrating warhead jacket, b. the individual effective radii of the projectiles being influenced by the type and quantity of explosive, c. the number of projectile groups distinguished according to the ignition moments of the backfiring charges of their projectiles, and d. the time intervals chosen between the ignitions of the backfiring charges of the individual projectile groups.

The scatter of the projectiles falling to earth individually after disintegration of the warhead jacket and hence the size of the ground area to be combated for a prolonged period are moreover influenced by the kind of disintegration of the warhead jacket. A disintegration of the warhead jacket by means of detonating cords equally spaced on the inner jacket side and ignited at a predetermined moment by a time fuze accommodated in the ogive of the warhead has proved suitable. Delays in the complete disintegration of the warhead jacket affecting the scatter of the projectiles and being undesirable for this reason are thus definitely avoided.

In accordance with another feature of the invention each projectile has been provided with two electrical ignition circuits, the one of which forming the impact fuze contains an electroresponsive detonator embedded in the backfiring charge, a charging capacitor, one or several voltage arrester(s), and two breaker contacts in series connection making contact at the impact on relatively hard ground, while the other ignition circuit forming the time-delay fuze contains besides that one of the two breaker contacts which already makes contact — unlike the other — at the impact on relatively soft ground, besides the voltage arrester(s), the besides the charging capacitor an ignition capacitior in parallel connection with the former and a charging resistor lying in one of the two conductor branches connecting the capacitors, said charging resistor being adjustable and having different dimensions, respectively, for at least part of the projectiles. The projectiles of the warhead according to the invention which are equipped with the impact and time-delay fuzes described above are neither sensitive to temperature nor susceptible to shock. These properties preventing the projectiles from detonating during transport and storage and being therefore extremely advantageous are above all due to the facts that both the activation of the ignition circuits by means of an electrolyte solution contained in a frangible container provided for in the known shell and the release of the open breaker contacts by means of a fluid also contained in a frangible container provided for in the known shell, too, are dispensed with.

According to a further feature of the invention an impact bow coordinated with the impacting end of the projectile and three separate foils of electroconductive material, which are arranged on the side opposite to the impacting side of the impact bow and which are spaced from each other and from the impact bow, form the two breaker contacts, the foil near the impact bow being connected to the ignition capacitor, the foil away from the impact bow being connected to the charging capacitor, and the central foil being connected to the electroresponsive detonator. The interspaces between the three foils as well as the foil thicknesses are so dimensioned that the impact bow causes all foils to make contact when impacting with relatively hard ground, while it causes only the nearby foil to make contact when impacting with relatively soft ground.

As a result of the development of the two breaker contacts described above and according to the invention and of the way in which their foils are coordinated with the charging capacitor, the ignition capacitor, and the electroresponsive detonator, the respective projectile is immediately fired back into the adjacent air region after impact with relatively hard ground which is due to the lacking charging resistor in the ignition circuit of the impact fuze then being initiated, said charging resistor effecting otherwise the delayed ignition of the backfiring charge. However, if the projectile impacts with relatively soft ground the charging resistor in the ignition circuit of the time-delay fuze being now intiated ensures that the backfiring charge is ignited and the respective projectile is thus fired back from the ground into the adjacent air region a shorter or longer period of time after impact depending on the dimensions of the charging resistor.

In a further development of the invention the charging capacitor, the ignition capacitor, the charging resistor as well as the voltage arrester or the voltage arresters are installed in the projectile itself, while the impact bow with the coordinated foils and the backfiring charge with the embedded electroresponsive detonator together with friction release cord or the like leading to a friction primer located in the projectile and forming an interrupted pyrotechnical chain together with a flame primer, a detonator being sensitive to flames, and an boosting charge embedded in the explosive charge of the projectile, said pyrotechnical chain remaining interrupted until the backfiring charge is ignited, are accommodated in the forward end portion of a casing containing the projectile, the rear end portion of this casing being provided with longitudinal slots and being so dimensioned in diameter that it can house the non-slotted portion of the casing of the respective projectile lying behind in the warhead jacket as well as a coaxial compression spring acting on this portion of the casing on the front side.

The abovementioned design measures that can be realized in a simple way result in projectiles of an extremely compact type of construction being ready for use at any moment and being safetied until impacting with the ground, a fact that — together with the kind of lining up projectiles lying one behind the other — makes it possible to house an optimum number of projectiles in a warhead of a given volume.

In an embodiment of the projectile of the invention warhead, which is preferred because of its especially compact construction, the projectile has an explosive charge preferably provided with pre-formed ball-shaped splinters, and is remarkable for a large penetration effect and high splinter densities, the charging capacitor, the ignition capacitor, the charging resistor, and the voltage arrestor or voltage arresters are embedded in the portion of the explosive charge adjoining the slotted end portion of the casing, i.e. they are grouped around a recess being open on the front side, the friction primer and the boosting charge ending in this recess and a block shiftable by means of a compression spring and containing the flame primer, the flame-sensitive detonator, and a tube connecting the flame-sensitive detonator with the flame primer being arranged in this recess. The contacts between flame primer and friction primer, on the one hand, and between flame-sensitive detonator and boosting charge, on the other hand, being undesirable for safety reasons up to the ignition of the backfiring charge, are avoided with this projectile type in that, within the range of the slotted end portion of the casing, the projectile rests against an eccentrically bored disk, which on its part is fixed in axial direction by radially inward pointing projections of the slotted end portion of the casing and, in cooperation with a stop pin of the block gearing into the eccentric bore, prevents that, up to the shearing off of the projections by the ignition of the backfiring charge, the flame primer moves toward the friction primer and the flamesensitive detonator moves toward the boosting charge under the influence of the compression spring.

The various features of novelty which characterize the invention are pointed out with particularity in the claims annexed to and forming a part of this specification. For a better understanding of the invention, its operating advantages and specific objects attained by its use, reference should be had to the accompanying drawings and descriptive matter in which there are illustrated and described preferred embodiments of the invention.

GENERAL DESCRIPTION OF THE PREFERRED EMBODIMENTS

Figure 1:
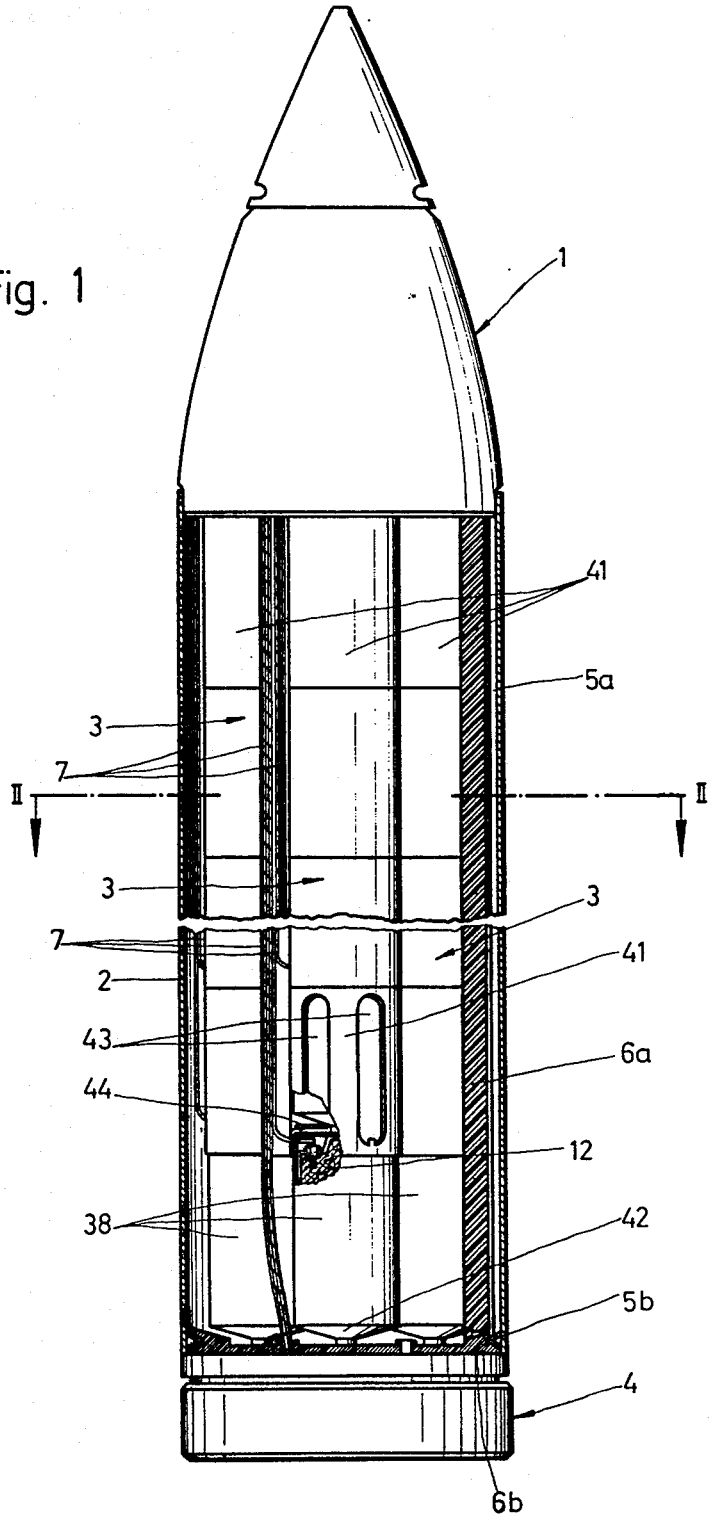
FIG. 1 illustrates one form of the invention warhead, partly in a longitudinal sectional view, in a very simplified way.
Figure 2:
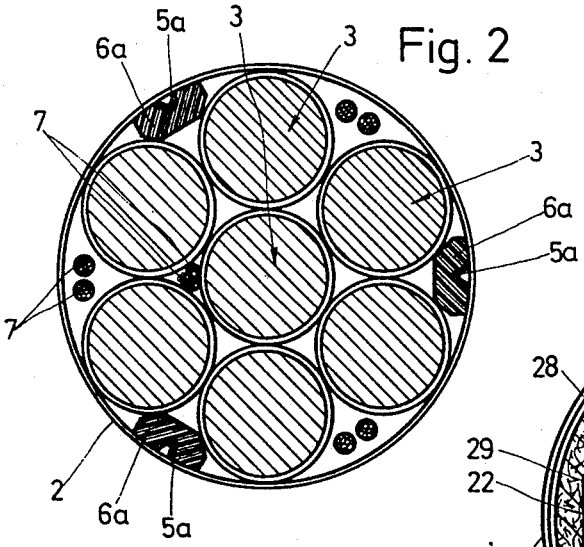
FIG. 2 is a sectional view taken on line II — II of FIG. 1.
Figure 5:
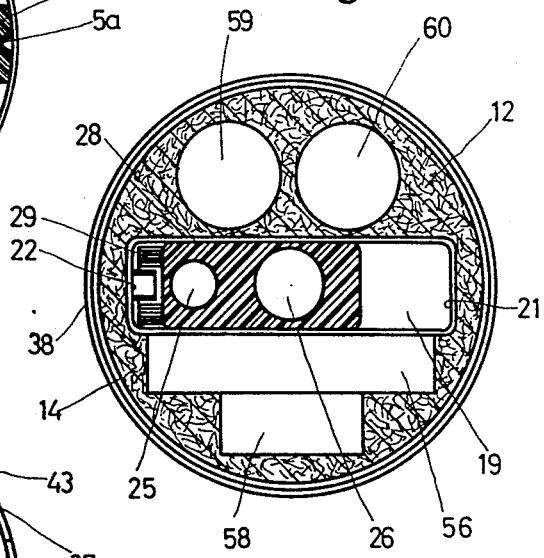
FIG. 5 is a sectional view taken on line V — V of FIG. 3.
Figure 6:
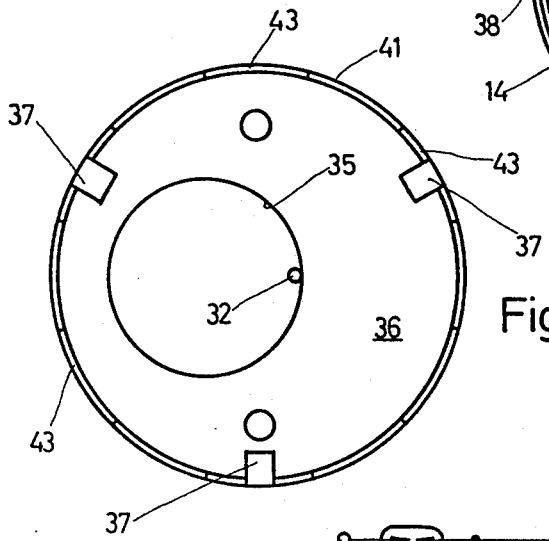
FIG. 6 is a sectional view taken on line VI — VI of FIG. 3.

The warhead according to FIGS. 1 and 2 essentially consists of an ogive 1, an outer jacket 2, and a connecting piece 4 forming the rear end portion of jacket 2, said connecting piece, owing to its design, permitting to connect the warhead with a launching or booster rocket. In the case of the present embodiment, four detonatibng cords 5*a*, 5*b* are arranged on the inner side of warhead jacket 2, surrounding, for instance, eight layers arranged one behind the other and consisting of seven splinter projectiles 3, which can be seen in FIG. 2. Three detonating cords 5*a* are distributed at equal interspaces around the circumference of the jacket and extend along the whole length of the jacket. The fourth detonating cord 5*b* is laid in circumferential direction of warhead jacket 2 within the range of connecting piece 4. All detonating cords 5*a*, 5*b* are connected with a time fuze — not shown in the Figure — which is accommodated in ogive 1 of the warhead and cause warhead jacket 2 to separate from connecting piece 4 and simultaneously to disintegrate to fragments of equal size at a moment determined by the time fuze. The splinter projectiles are protected against the pressure effect by means of shock-absorbing protection strips 6*a*, 6*b*. At the moment of disintegration of warhead jacket 2 by means of detonating cords 5*a*, 5*b* splinter projectiles 3 hitherto prevented for moving in radial and axial directions are released, the electrical lines 7 of said projectiles serving to charge their ignition systems consisting each of an impact fuze and of a time-delay fuze. After their release, the projectiles fall to earth — suitably scattered — their fall being braked and stabilized. Construction details are given in FIGS. 3 to 6.

According to FIGS. 3 to 6 each splinter projectile 3 essentially consists of a rotationally symmetric explosive charge 10, of a projectile casing 14 forming a closing shape to explosive charge 10, and of a splinger shirt 17 composed of ball-shaped splinters 15 and filler 16, said splinter shirt forming a closing shape to projectile casing 14 expect for its parts covering rear face 11 and section 12 of explosive charge 10, said section 12 adjoining rear face 11. A centric longitudinal bore 18 has been made in explosive charge 10, whose section 12 adjoining rear face 11 is somewhat larger in diameter than that section adjoining its forward cambered face 13, said longitudinal bore 18 being enlarged to form a recess 19 of rectangular cross-section within the range of rear face 11 of explosive charge 10. The shoulder of explosive charge 10 existing at the transition point between the centric longitudinal bore 18 and recess 19 is marked by number 20. This shoulder 20 is provided with a blindened bore 23 within the range of one (21) of the two narrow sides 21, 22 of recess 19 (FIG. 5) for receiving a boosting charge 24.

That part of recess 19 of explosive charge 10 which lies between blind-end bore 23 filled with boosting charge 24 and its narrow side 22 farther away from blind-end bore 23 is occupied by a shiftable block 28. A cone-shaped compression spring 29 acts upon this block 28 containing a flame primer 25, a flame-sensitive detonator 26, and a tube 27 connecting flame primer 25 with flame-sensitive detonator 26, said compression spring 29 serving to shift block 28 toward boosting charge 24. For the present, however, block 28 is prevented from carrying out such a movement by stop in 30 being set in block face 33 flush with splinter-free face 11 of explosive charge 10. By its part 31 projecting over block face 33 stop pin 30 is led outward through slot 34 extending in the direction of the spring tension in that portion of projectile casing 14 which covers splinter-free face 11 of explosive charge 10, and its free end 32 extends into an eccentric bore 35 of a disk 36 normal to the longitudinal axis of the projectile, said eccentric bore 35 intersecting the springnear end of the slot 34 of the projectile casing in such a way that any movement of stop pin 30 and hence of block 28 is impossible.

Eccentrically bored disk 36 rests against slotted projectile casing 14 on the one hand, and against radial inward directed projections 37 on the other hand. These projections 37 — for the projectile type in question three — belong to a casing 38 serving projectile 3 as a container, said casing 38 being provided with end portions 41, 42 projecting over both faces 11, 13 of explosive charge 10. End portion 41 of projectile casing 38 projecting over the rear splinter-free face 11 of explosive charge 10 is provided with longitudinal slots 43 serving the stabilization in flight and receives the non-slotted portion of the casing being somewhat smaller in diameter with the other end portion 42 of the casing projecting over the forward face 13 of explosive charge 10 of the respective splinter-projectile 3 lying behind as well as as a conical spring 44 acting on the face of the last-mentioned portion 42 of the casing. The non-slotted end portion 42 of each projectile casing 38 projecting over forward face 13 of explosive charge 10 houses an impact bow 45 being accessible from outward, a backfiring charge 46 with an embedded electroresponsive detonator 47, and between impact bow 45 and backfiring charge 46 — at a certain distance from each other — three foils 48, 49, 50 of electroconductive material normal to the longitudinal axis of the casing. The forward end portion 42 of the casing being provided with a lining 51, which simultaneously serves splinter projectile 3 as a buffer stop, also houses a friction release cord 53 wound up to a coil 52, said friction release cord 53 being fastened to the forward end portion 42 of the casing on the one hand, and to a friction primer 54 fitted in the centric longitudinal bore 18 of explosive charge 10 in the other hand. This friction primer 54 is fixed in axial direction by block 28 in recess 19 on the one hand, and by a rubber plug 55 on the other hand.

Figure 7:
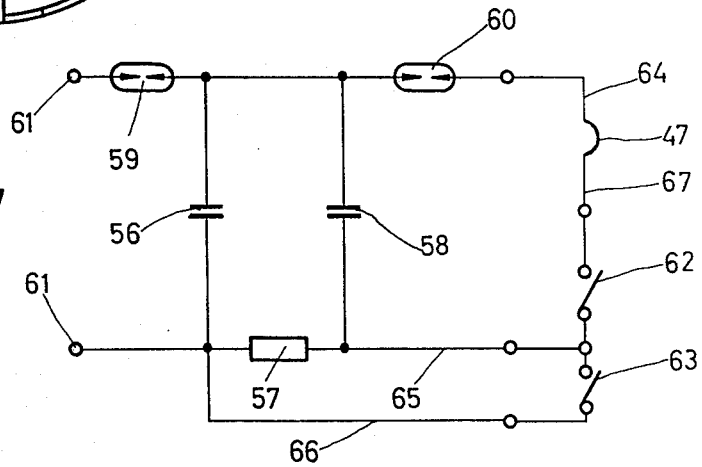
FIG. 7 is a circuit diagram of the ignition system of the splinter projectile according to FIGS. 3 to 6.
Figure 3:
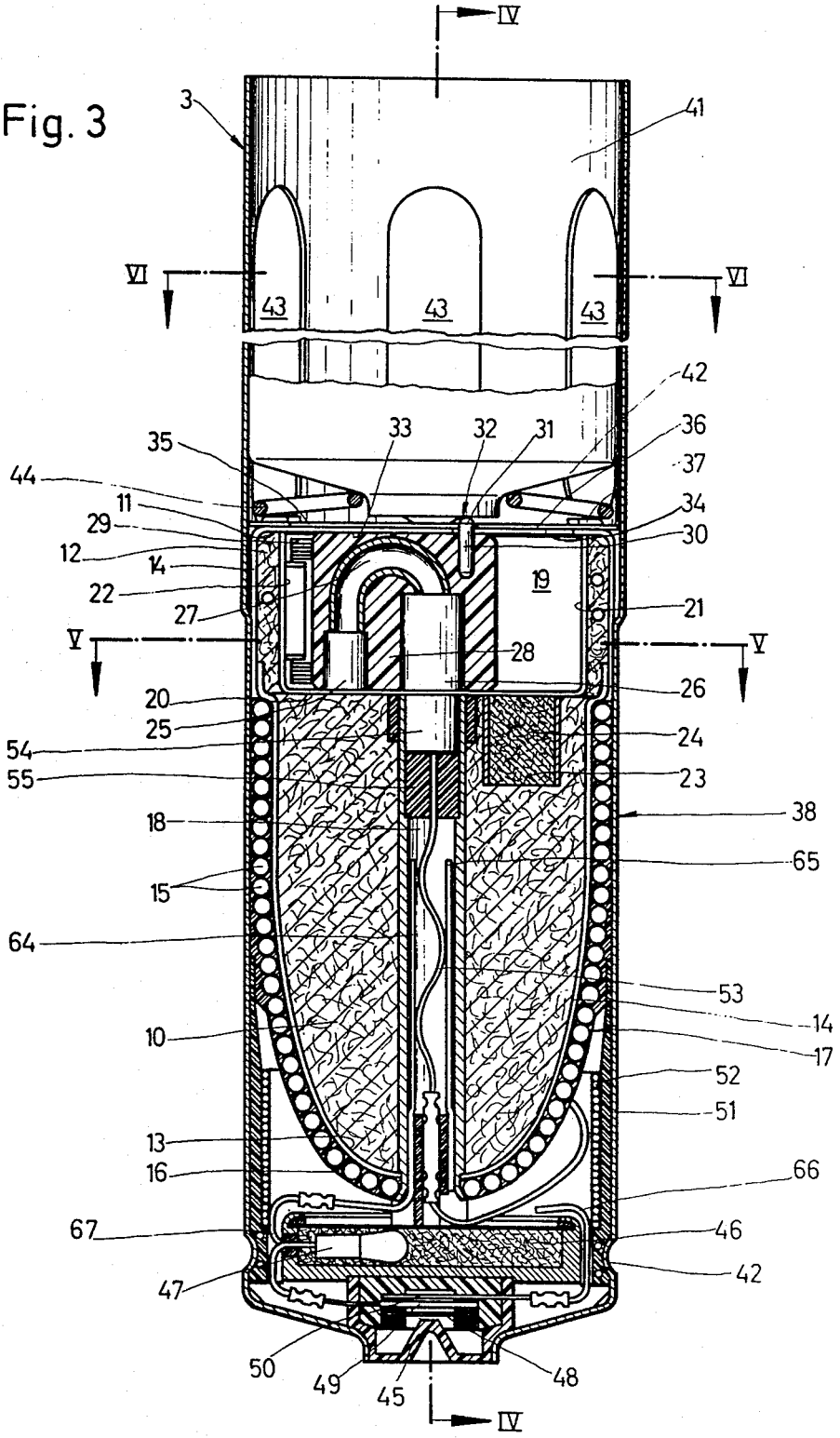
FIG. 3 is also a longitudinal sectional view on a larger scale of a projectile designed as a splinter projectile of the warhead type shown in FIGS. 1 and 2.
Figure 4:
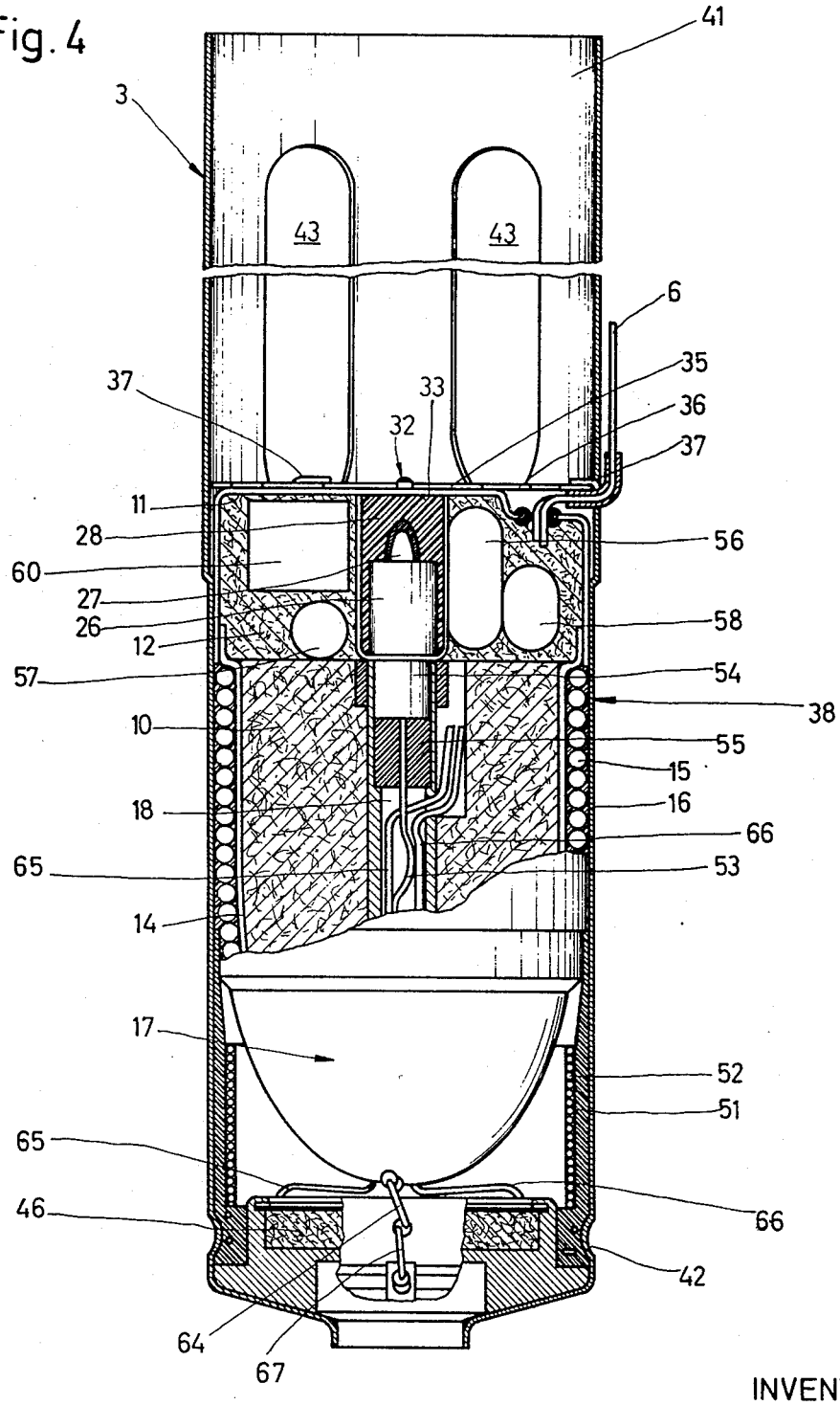
FIG. 4 is a sectional view taken on line IV — IV of FIG. 3.

The abovementioned impact bow 45, the electroresponsive detonator 47 embedded in backfiring charge 46, and the three foils 48, 49, 50 between impact bow 45 and backfiring charge 46 are structural elements of an ignition system which also contains a charging capacitor 56, a charging resistor 57, an ignition capacitor 58, and two voltage arresters 59, 60. Charging capacitor 56, charging resistor 57, ignition capacitor 58, and voltage arresters 59, 60 are altogether accommodated in portion 12 of explosive charge 10, said portion 12 surrounding recess 19. Their coordination is shown in the circuit diagram of the electrical ignition system represented in FIG. 7, in which the terminals are denoted by number 61, the one breaker contact formed by foil 48 near impact bow 45 and by central foil 49 is denoted by 62, and the other breaker contact formed by central foil 49 and foil 50 farthest away from impact bow 45 is denoted by 63. Those line sections which electrically connect voltage arresters 59, 60 with electroresponsive detonator 47, ignition capacitor 58 with foil 48 near impact bow 45, and charging capacitor 56 with foil 50 farthest away from impact bow 45, and which — as can be seen in FIGS. 3 and 4 — mostly run in centric longitudinal bore 18 of explosive charge 10 of splinter projectile 3 are numbered 64, 65, 66, while that line section which connects electroresponsive detonator 47 with central foil 49 is denoted by 67.

The warhead type the design of which has been explained by means of FIGS. 1 to 7 functions as follow: As soon as warhead jacket 2 is disintegrated and separated from connecting piece 4 by the ignition of detonating cords *5a, 5b,* splinter projectiles 3 fitted into each other as described above are scattered by the effect of compression springs 44 housed in their slotted end portions 41 of the casings and fall to earth in a steep, braked flight, the slotted end portions 41 of the projectile casings having a stabilizing effect in this flight. If the ground within the impact area of a splinter projectile 3 is relatively hard, impact bow 45 makes contact with all three foils 48, 49, 50. The one ignition circuit forming the impact fuze is thus closed, said ignition circuit containing only charging capacitor 56, voltage arresters 59, 60, and eletroresponsive detonator 47, i.e. no structural element causing any delay. Therefrom results an immediate ignition of backfiring charge 46 by electroresponsive detonator 47. However, if the ground within the impact area of splinter projectile 3 is relatively soft, impact bow 45 makes contact only with nearby foil 48 and with central foil 49. This effects that the other ignition circuit forming the time-delay fuze is closed now, this ignition circuit containing besides the abovementioned structural elements an ignition capacitor 58 in parallel connection with charging capacitor 56 and a charging resistor 57 interconnected between the two capacitors 56, 58. In such a case the ignition of the backfiring charge 46 is more or less delayed depending on the dimensioning of charging resistor 57. In the case of its ignition the backfiring charge 46 effects that the radial inward directed projections 37 of projectile casing 38 shear off, disk 36 which arrests block 28 in recess 19 of explosive charge 10 lifts off from splinter projectile 3, and splinter projectile 3 is fired out of projectile casing 38 back into the adjacent air region. During this moving phase of splinter projectile 3, conical spring 29 acting on block 28 brings this block into the "armed position", i.e. the therein embedded flame primer 25 is brought to coincidence with friction primer 54, and flame-sensitive detonator 26 is brought to coincidence with boosting charge 24. As soon as splinter projectile 3 fired from the ground back into the adjacent air region by means of backfiring charge 46 has reached an altitude corresponding to the length of friction release cord 53, friction primer 54 is ignited by friction release cord 53, and flame primer 25 is ignited by friction primer 54. Tube 27 connecting flame primer 25 with flame-sensitive detonator 26 makes it possible that flame-sensitive detonator 26 is initiated, said flame-sensitive detonator 26 starting the explosion of explosive charge 10 of splinter projectile 3 through boosting charge 24. The splinter cone which is caused by this explosion is directed to earth around the explosion point.

What is claimed is:

1. A warhead with an disintegrating jacket to house several projectiles, in particular splinter projectiles, each of them being equipped with an ignition and backfiring charge system, and each falling to earth individually after disintegration of the warhead jacket, and being fired upwards from the ground by means of the backfiring charge system ignited by the ignition system, said ignition system comprising a time-delay fuze, which is initiated when the projectile impacts with relatively soft ground and which ignites the backfiring charge after adjusted times differing at least partly for the individual projectiles, and an impact fuze, which effects an immediately ignition of the backfiring charge when the projectile strikes relatively hard ground.

2. A warhead, as claimed in claim 1, in which each projectile has two electrical ignition circuits, the one of which forming the impact fuze contains an electroresponsive detonator embedded in the backfiring charge, a charging capacitor, one or several voltage arresters and two breaker contacts in series connection making contact at the impact on relatively hard ground, while the other ignition circuit forming the timedelay fuze contains besides that one of the two breaker contacts which already makes contact — unlike the other — at the impact on relatively soft groubd, besides the voltage arrester or voltage arresters, and besides the charging capacitor an ignition capacitor in parallel connection with the charging capacitor and a charging resistor lying in one of the two conductor branches connecting the capacitors, said charging resistor being adjustable and differently dimensioned, respectively, for at least part of the projectiles.

3. A warhead, as claimed in claim 2, in which an impact bow coordinated with the impacting end of the projectile and three separate foils of electroconductive material, which are arranged on the side opposite to the impacting side of the impact bow and which are spaced from each other and from the impact bow, form the two breaker contacts, the foil near the impact bow being connected to the ignition capacitor, the foil away from the impact bow being connected to the charging capacitor, and the central foil being connected to the electro-responsive detonator, and the interspaces between the three foils as well as the foil thicknesses are so dimensioned that the impact bow causes all foils to make contact at the impact on relatively hard ground, while it causes only the nearby foil and the central foil to make contact at the impact on relatively soft ground.

4. A warhead, as claimed in claim 1, in which the charging capacitor, the ignition capacitor, the charging resistor as well as the voltage arrester and the voltage arresters, respectively, are installed in the projectile, while the impact bow with the coordinated foils and the backfiring charge with the embedded electro-responsive detonator together with a friction release cord or the like leading to a friction primer located in the projectile and forming an interrupted pyrotechnical chain together with a flame primer, a detonator being sensitive to flames, and an boosting charge embedded in the explosive charge of the projectile, said pyrotechnical chain remaining interrupted until the backfiring charge is ignited, are accommodated in the forward end portion of a casing containing the projectile, the rear end portion of this casing being provided with longitudinal slots and receiving the non-slotted portion of the casing of the respective projectile lying behind in the warhead jacket as well as a coaxial compression spring acting on this portion of the casing.

5. A warhead, as claimed in claim 4, in which the charging capacitor, the ignition capacitor, the charging resistor as well as the voltage arrester and the voltage arresters, respectively, are embedded in the portion of the explosive charge of the projectile adjoining the slotted end portion of the casing, i.e. they are grouped around a recess being open on the front side, the friction primer and the boosting charge ending in this recess and a block shiftable by means of a compression spring and containing the flame primer, the flamesensitive detonator, and a tube connecting the flame-sensitive detonator with the flame primer, being arranged in this recess.

6. A warhead, as claimed in claim 5, in which, within the range of the slotted end portion of the casing, the projectile rests against an eccentrically bored disk, which — on its part — is fixed in axial direction by radially inward pointing projections of the slotted end portion of the casing and, in cooperation with a stop pin of the block gearing into the eccentric bore, prevents that, up to the shearing off of the projections effected by the ignition of the backfiring charge, the flame primer moves toward the friction primer and the flamesensitive detonator moves toward the boosting charge under the influence of the compression spring.

7. A warhead comprising a housing adapted to fall apart, at least one splinter projectile in said housing having an impact bow end, a main explosive charge in said projectile, a backfire charge in said projectile, and an ignition device in said projectile including first means connected to said backfire charge to ignite said backfire charge when said impact bow is subjected to an initial impact at the ground of a first intensity, for example, due to a contact with hard ground, and a second means including a time delay connected to said backfire charge to cause ignition thereof after a predetermined time delay when said impact bow is subjected to an initial impact at the ground of a second intensity, for example due to contact with soft ground, and which is also connected to said main charge to ignite said main charge after a predetermined time delay.

8. A warhead according to claim 7, wherein said housing includes a tubular casing, said backfire charge being effective to fire said projectile out of said casing after the operation of said time delay, a friction primer including a member which is adapted to be paid out upon movement of said missile out of said casing after ignition of said backfire charge and connected to said main charge to ignite said main charge after said projectile has moved out of said casing by a predetermined amount.

9. A splinter projectile for use in a warhead with a plurality of other splinter projectiles comprising a housing having an impact bow end, a main explosive charge in said projectile, a backfire charge in said projectile, and an ignition device in said projectile including first means connected to said backfire charge to ignite said backfire charge when said impact bow is subjected to an initial impact at the ground of a first intensity, for example due to contact with hard ground, and second means including a time delay connected to said backfire charge to cause ignition thereof after a predetermined time delay and also connected to said main charge to ignite said main charge after a predetermined time delay.

10. A splinter projectile according to claim 9, wherein said main charge includes a hollow tubular portion, a plurality of contact foils located in said projectile housing adjacent said contact bow, said foils being spaced from said bow and being forced into contact with said bow, depending upon the amount of deformation of said bow at impact on the ground, said first means including an electro-responsive detonator connected to said backfiring charge to ignite said backfiring charge and which is also connected to one of said foils so as to be actuated by said bow contacting one of said foils.

11. A splinter projectile, according to claim 10, including a friction detonator connected to said main charge, said main charge being separable from said projectile housing, and said friction detonator being actuable upon a prdetermined amount of separation to ignite said main charge and comprising said second means.

* * * * *